United States Patent [19]

Ketterer

[11] 4,428,312

[45] Jan. 31, 1984

[54] LOOP POSITIONING ARRANGEMENT FOR DOUBLE POINTED LOOPER SEWING MACHINE

[75] Inventor: Stanley J. Ketterer, Jamesburg, N.J.

[73] Assignee: The Singer Company, Stamford, Conn.

[21] Appl. No.: 506,757

[22] Filed: Jun. 22, 1983

[51] Int. Cl.[3] ..... D05B 1/06

[52] U.S. Cl. ..... 112/199; 112/169; 112/110

[58] Field of Search ..... 112/199, 197, 165, 166, 112/169, 110, 111, 112

[56] References Cited

U.S. PATENT DOCUMENTS

| | | | |
|---|---|---|---|
| 1,812,327 | 6/1931 | Ericsson | 112/110 |
| 2,410,679 | 11/1946 | Pikul | 112/111 |
| 2,928,363 | 3/1960 | Saltz et al. | 112/169 |
| 3,165,080 | 1/1965 | Castelletti | 112/169 X |
| 3,837,306 | 9/1974 | Doyel | 112/169 |

*Primary Examiner*—H. Hampton Hunter

*Attorney, Agent, or Firm*—William V. Ebs; Edward L. Bell; Robert E. Smith

[57] ABSTRACT

A pivotally movable cam having a double pointed looper thereon for seizing thread loops on one side of a sewing needle is formed with raised surfaces to engage the thread on the opposite side of the needle and thereby position the thread loops for looper point seizure.

6 Claims, 5 Drawing Figures

LOOP POSITIONING ARRANGEMENT FOR DOUBLE POINTED LOOPER SEWING MACHINE

BACKGROUND OF THE INVENTION

1. Field of the Invention

The invention relates to chain stitch sewing machines having double pointed loopers.

2. Description of the Prior Art

Single thread, chain stitch sewing machines utilizing double pointed loopers are commonly used in machines for sewing buttons onto garments and sewing a series of substantially superimposed stitches for tacking together multiple pieces of material. Such machines may be seen, for example, in U.S. Pat. No. 2,410,679 of J. H. Pikul for "Sewing Machine", issued Nov. 5, 1946, in U.S. Pat. No. 3,837,306 of John S. Doyel for "Portable Lightweight Hand-Held Sewing Machine", issued Sept. 24, 1974, and in U.S. Pat. No. 3,165,080 of L. Castelletti for "Hand Operated Button Sewer", issued Jan. 12, 1965.

The present invention is directed to a thread loop controlling arrangement for use in a chain stitch machine with a double pointed looper, and has a prime object the positioning of thread loops for looper point seizure.

It is another object of the invention to provide a double pointed looper chain stitch sewing machine with means for disposing thread loops, and for relatively disposing a sewing needle and looper points, all in a manner effective to facilitate seizure of the thread loops by the looper.

Other objects and advantages of the invention will become apparent during a reading of the specification taken in connection with the accompanying drawings.

SUMMARY OF THE INVENTION

A chain stitch sewing machine having a double pointed looper affixed to a pivotally mounted cam and including means for imparting pivotal movement to the cam to thereby alternately dispose each of the two looper points for seizing a loop of thread extending to one side of a sewing needle is provided on said cam with at least one raised surface to engage the thread on the opposite side of the needle from the loop and thereby cause the loop to be moved into position for looper point seizure. An additional raised surface is also preferably provided on said cam to engage the sewing needle and relatively dispose the needle and looper points for loop point seizure.

DESCRIPTION OF THE INVENTION

Figure 1:
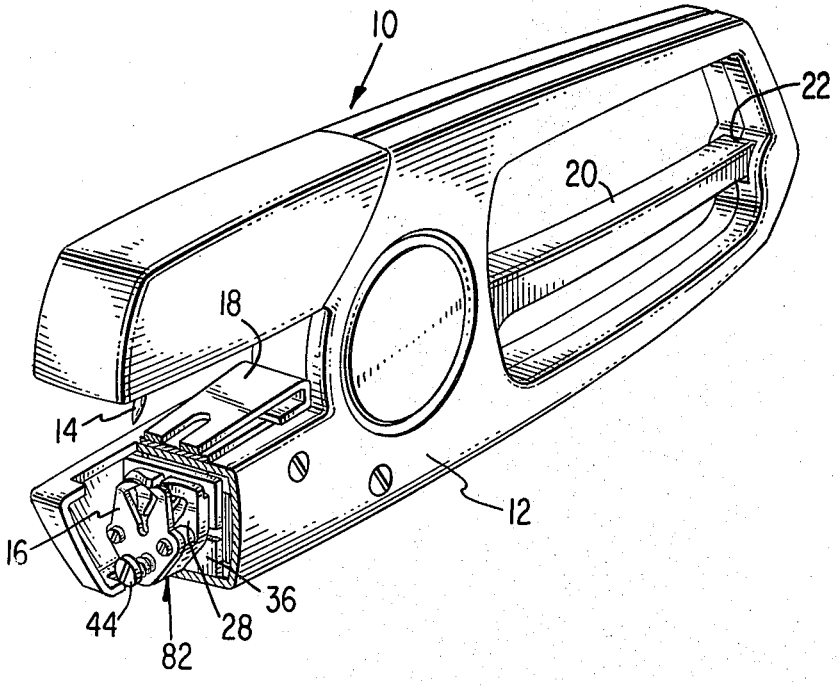
FIG. 1 is a perspective view of a hand operable sewing machine including the arrangement of the invention.

Referring to FIG. 1, there is shown a hand held sewing machine 10 including a frame 12, a thread carrying needle 14 arranged for reciprocating movement, and a pivotally movable looper 16 with opposing loop seizing points 17 and 19 which cooperate with the needle in the formation of chain stitches. A work piece feed mechanism 18 is arranged to undergo movements in cooperation with those of the needle 14 and the looper 16 in a well known manner, to properly position the work piece. A hand operated lever 20 which is pivotally attached at one end 22 to the frame 12 is interconnected with the needle 14 and feed mechanism 18 to impart the desired movements thereto. Such interconnections may be effected as in the manner shown, for example, in the copending patent applications of Karl Hugo Killinger for "Actuating Mechanism for a Double Pointed Looper in a Sewing Machine", Ser. No. 331,699, filed Dec. 17, 1981, and "Feeding Mechanism for Double Pointed Looper Sewing Machine", Ser. No. 461,825, filed Jan. 28, 1983.

Figure 2:
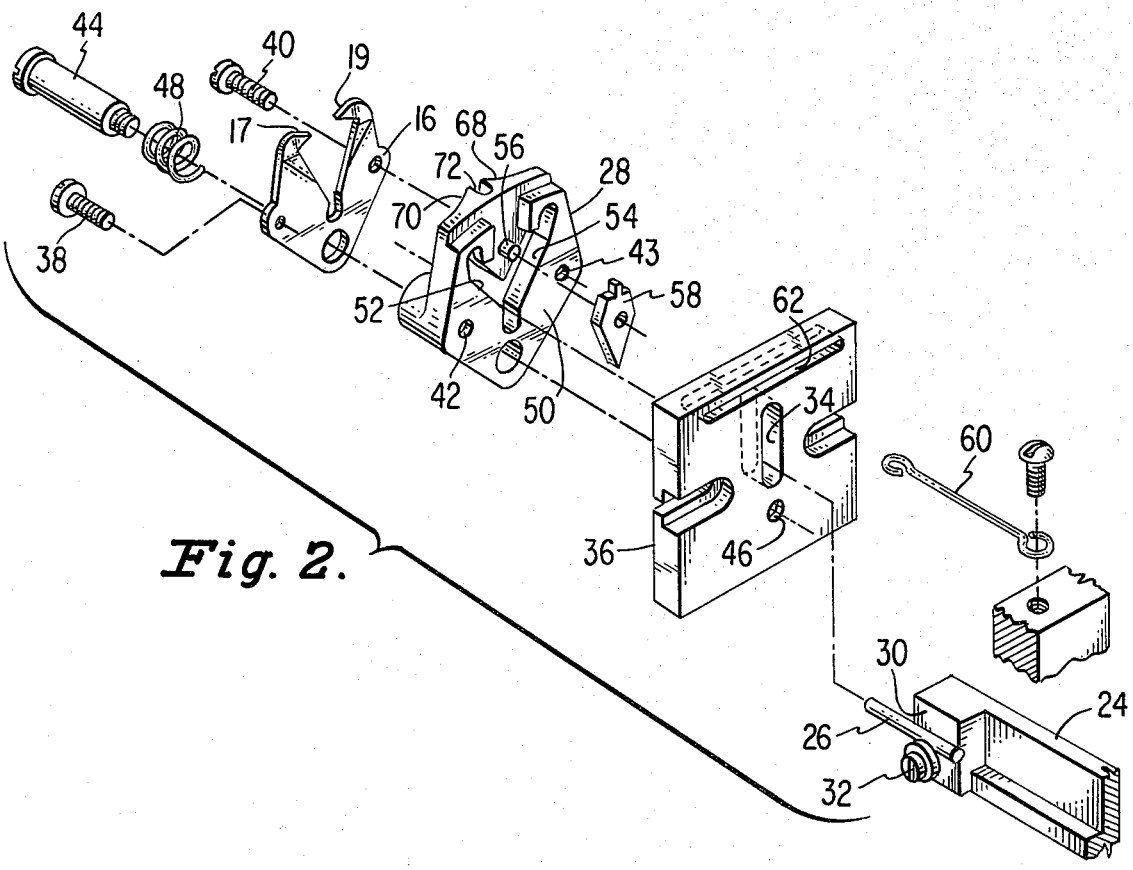
FIG. 2 is an exploded perspective view showing looper actuating mechanism for said machine.

The hand operated lever 20 acts through a drive arm 24, (see FIG. 2), an actuator in the form of a drive pin 26 on the arm, and a povited cam 28 driven by the actuator to impart movement to the looper 16. The drive pin 26 is held in place on the free end portion 30 of arm 24 by a suitable fastener 32, and extends through an elongated hole 34 in a guide block 36 which is rigidly attached to the frame 12, the elongated hole being arranged to slidingly receive drive pin 26 for the guiding thereof in a vertical plane. The drive pin further extends beyond the guide block to the cam 28 to provide for the actuation of the cam and thereby the looper 16 which is affixed to the cam with screw fasteners 38 and 40 that are threaded into holes 42 and 43, respectively in the cam.

Cam 28 with attached looper 16 (designated in the drawings as assembly 82) is pivotally attached to the guide block 36 with a screw fastener 44 which is threaded into a hole 46 formed in the guide block. A helical compression spring 48 between the head of the screw fastener 44 and the looper 16 urges the cam and looper toward the guide block, and surface 50 of the cam is thereby disposed for sliding engagement with the guide block. The cam includes two cam tracks 52 and 54 which intersect at their lower extremities and receive an end portion of the drive pin 26 extending through elongate hole 34 in block 36. Pin 26 which is vertically reciprocated by operation of handle 20 moves along the tracks to impart reciprocatory motion to the cam. Cam 28 includes a fixed pin 56 which pivotally supports a gate 58 for alternately blocking each of the two intersecting cam tracks 52 and 54 so that drive pin 26 can slidingly engage the other track to effect pivotal movement of the looper 16 as described in the aforementioned U.S. patent application with Ser. No. 331,699, and as required to alternately place each of the two loop seizing points 17 and 19 on the looper into cooperative association with the needle to provide for the formation of chain stitches. The gate is positioned in the manner fully described in the said pending patent application, Ser. No. 331,699, by drive pin 26 and a spring 60 extending through a slot 62 in block 36.

Cam 28 is formed on opposite sides of a central plane that includes its pivotal axis 66, with like raised surface portions 68 and 70. The raised surface portions are separated by a narrow gap 72 and are at a maximum height at the side edges of the gap. The said surface portions taper downwardly toward opposite sides of the cam to provide needle clearance. Cam 28 is also formed under gap 72 and the surface portions 68 and 70 with a centrally located raised triangularly shaped needle deflecting surface portion 74. Cam 28 is preferably a one-piece molded plastic part.

Chain stitches are formed with double pointed loopers in a manner which is well understood in the art, and in accordance with which the looper points are caused to alternately seize and hold onto a needle carried loop of thread until the needle can pierce the held loop with a new loop. However, difficulties have been experienced due to the failure at times of the looper to seize thread loops as required for the proper formation of stitches. In the machine 10 of the invention, such difficulties are minimized with the raised surface portions provided on cam 28.

Figure 3:
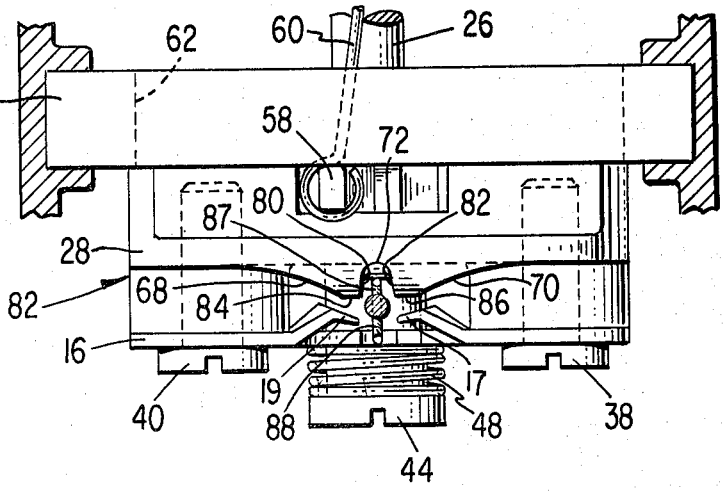
FIG. 3 is a top view of a looper and cam assembly.
Figure 4:
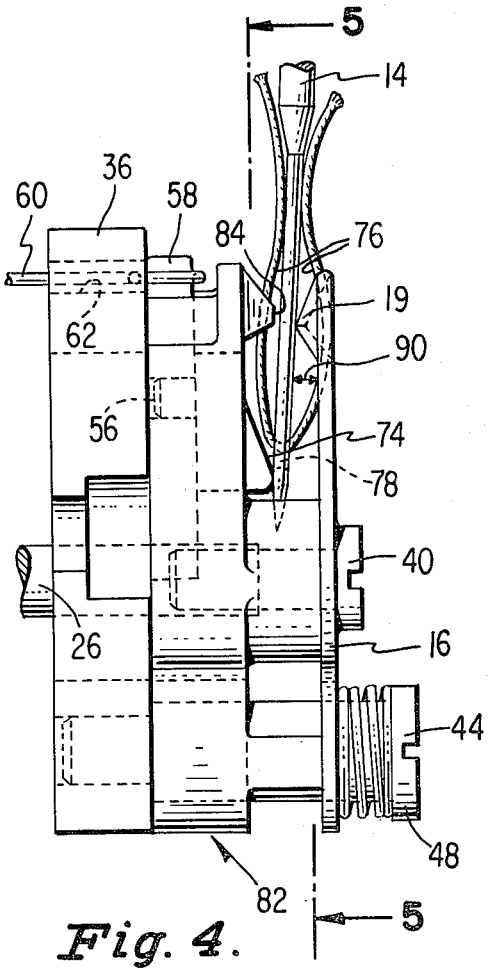
FIG. 4 is an end view of the looper and cam assembly.
Figure 5:
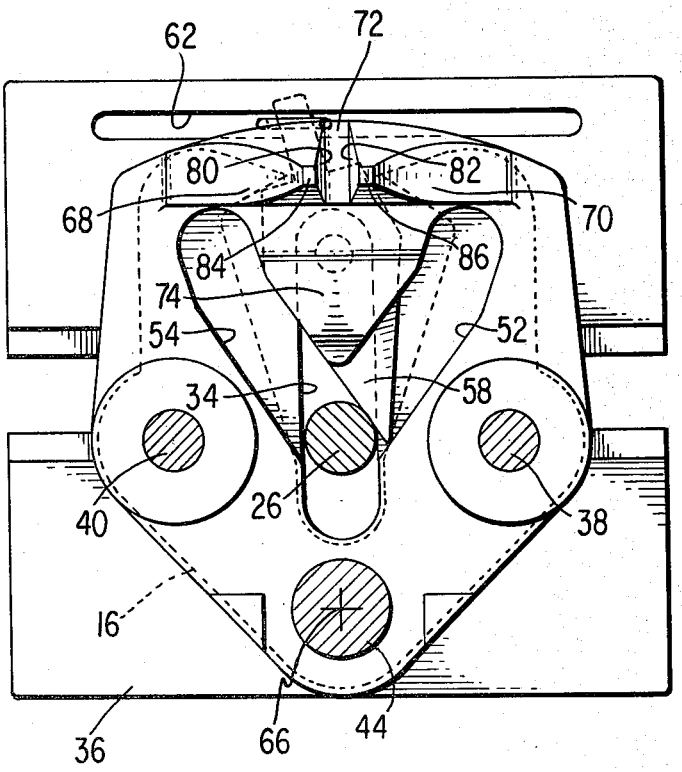
FIG. 5 is a front elevational view of the cam taken substantially on the plane of the line 5—5 of FIG. 4.

A loop 76 extending through the eye 78 of needle 14 is presented by the needle for looper point seizure as the needle ascends from a down position and the looper pivots in one direction or the other through an upright position wherein gap 72 in cam 28 is aligned with the needle (FIG. 3). Gap edge 80 and peaked area 84 of raised surface portion 68, or gap edge 82 and peaked area 86 of raised surface portion 70, depending upon the direction of movement of cam 28 and attached looper 16, engage the rear limb 87 of loop 76. The gap edge throws the loop in a direction resulting in movement of front limb 88 toward the advancing loop point 17 or 19, and the peaked area of the raised surface portion extending to such gap edge urges thread through the eye of the needle to enlarge the opening 90 between the needle and front limb 88. Movement of the looper point into the loop at the front of the needle through opening 90 is therefor facilitated, and the tendency, which has heretofor existed, for the looper to pass by the needle without seizing the thread because of improper presentation of thread loop, due, for example, to a natural twist in the sewing thread is minimized.

The needle 14 is engaged by raised surface portion 74 during presentation of loop 76 for loop seizure, and is deflected within the elastic limit of the part to provide an optimum predetermined spatial relationship between the needle and looper points at the time of loop seizure. The relative positions of the needle and looper points is thereby rendered independent of manufacturing tolerance variations in the needle and looper mechanism, and loop seizure is more reliably assured.

It is to be understood that the present disclosure relates to a preferred embodiment of the invention which is for purposes for illustration only, and is not to be construed as limiting the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In a sewing machine, a frame, a thread carrying needle arranged for reciprocating motion in the frame, a looper having two loop seizing points, a cam which has the looper affixed thereon and is mounted for pivotal movement in the machine, actuating means for effecting said motion thereby alternately disposing each of the said two looper points for seizing a loop of thread extending to one side of the needle, at least one raised surface on said cam engageable with the thread on the opposite side of the needle for moving the loop into position for looper point seizure.

2. The combination of claim 1 including an additional raised surface on the cam engageable with the needle for relatively disposing the needle and looper points for loop seizure.

3. The combination of claim 1 wherein said one side of the needle is the front side.

4. The combination of claim 3 wherein the cam includes a pair of raised surfaces which alternately engage thread on said opposite side of the needle and position the loop for seizure by the looper points.

5. The combination of claim 4 wherein said raised surfaces are symmetrically arranged with respect to a plane located midway between the looper points and extending through the pivotal axis of the cam.

6. The combination of claim 5 including an additional raised surface on the cam in said plane and engageable with the needle for relatively disposing the needle and looper points for loop seizure.

* * * * *